US005499711A

United States Patent [19]

Kozak

[11] Patent Number: 5,499,711

[45] Date of Patent: Mar. 19, 1996

[54] FOLDABLE CONTAINER FOR DISPLAYING TOOLS

[76] Inventor: Burton Kozak, 1300 N. Lake Shore Dr., #28C, Chicago, Ill. 60610

[21] Appl. No.: 226,674

[22] Filed: Apr. 12, 1994

[51] Int. Cl.[6] ..... B65D 85/20

[52] U.S. Cl. ..... 206/45.19; 206/45.24; 206/372; 206/563; 206/806; 206/497

[58] Field of Search ..... 206/45.14, 45.19, 206/45.24, 370–380, 443, 486, 419, 421, 562, 563, 806, 497

[56] References Cited

U.S. PATENT DOCUMENTS

| | | | |
|---|---|---|---|
| 2,355,206 | 8/1944 | Davidson, Jr. | 206/562 |
| 2,712,189 | 7/1955 | Grossman | 206/45.19 |
| 3,434,649 | 3/1969 | Goings | 206/563 |
| 4,030,599 | 6/1977 | Bruni | 206/379 |
| 4,032,008 | 6/1977 | Vecchiarelli | 206/379 |
| 4,503,975 | 3/1985 | Meyers et al. | 206/806 |
| 4,733,533 | 9/1988 | Greene | 206/288 |
| 4,813,551 | 3/1989 | Kuo | 206/377 |
| 4,844,249 | 7/1989 | Coulombe | 206/563 |
| 4,905,832 | 3/1990 | Boll et al. | 206/806 |

FOREIGN PATENT DOCUMENTS

| | | | |
|---|---|---|---|
| 9310010 | 5/1993 | WIPO | 206/563 |

*Primary Examiner*—Jimmy G. Foster

*Attorney, Agent, or Firm*—Marshall, O'Toole, Gerstein, Murray & Borun

[57] ABSTRACT

In order to be able to ship and, later, display a plurality of tools, each of which has a handle and a shaft, a foldable container formed of sheet material is disclosed which is defined by a plurality of walls, including at least a side wall and a top wall having a plurality of openings therein. The openings include a plurality of first openings each formed to receive the shaft of one of the tools and to support the tool with the handle positioned thereabove and including a plurality of second openings each formed to receive the handle of one of the tools and to support the tool with the shaft positioned thereabove. With these features of construction, the container further includes a display panel extending to a point above the top panel and, preferably, the container is a generally rectangular box, and the openings include holes and cutouts arranged in alternating fashion in at least two rows parallel to the display panel.

19 Claims, 3 Drawing Sheets

FOLDABLE CONTAINER FOR DISPLAYING TOOLS

FIELD OF THE INVENTION

The present invention is generally related to containers and, more particularly, a container for displaying a plurality of tools.

BACKGROUND OF THE INVENTION

As will be appreciated by those in the tool industry, many tools are displayed in retail environments on racks and the like. This is done, of course, because of the recognized advantages to a consumer due to the opportunity to inspect a tool which is displayed on a rack much more thoroughly than with those in a normal shipping container. When so displayed, the features of the tool can be closely examined by the consumer to make an informed decision as to purchase.

However, if a tool is to be displayed for sale on a rack, it oftentimes requires an expense for the retailer that is unacceptable. This expense is inherent not only in the cost of the rack or other display means but also in the necessity of physically removing the tool from a container in which it is shipped from the point of manufacture to the point of sale. As will be appreciated, this is a time-consuming step that is almost a practical necessity in existing practice for major retailers.

For this reason, there has become an increasing awareness of the significant desirability of display containers, i.e., containers in which products may be displayed for the consumer. It is known to be desirable, for instance, for a product to not only be capable of shipment in a container, but for that container to also be capable of serving as a point of sale display for the product once it reaches the retailer. While it is known that such a container is desirable, the stage of development of such containers has made it impossible to enjoy all advantages that might be derived therefrom.

The present invention is directed to overcoming one or more of the foregoing problems and achieving one or more of the resulting objects by providing a container for displaying a plurality of tools in a most highly desirable manner.

SUMMARY OF THE INVENTION

It is therefore a principal object of the present invention to provide a container for displaying a product therein. It is a further object of the present invention to provide such a container especially suited for displaying a plurality of tools each of which has a handle and a shaft. It is an additional object of the present invention to provide a foldable container which is formed of sheet material.

Accordingly, the present invention is directed to a container for displaying a plurality of tools each of which has a handle and a shaft. The container comprises container means defined by a plurality of walls, including at least a side wall and a top wall. The top wall has a plurality of openings, including a plurality of first openings each formed to receive the shaft of one of the tools and to support the tool with the handle positioned thereabove and includes a plurality of second openings each formed to receive the handle of one of the tools and to support the tool with the shaft positioned thereabove. The container is also such that the container means further includes a display panel extending to a point above the top panel. In the preferred embodiment, the first openings are generally round holes, and the second openings are generally square cutouts.

In the exemplary embodiments, the generally round holes are provided in the top wall to have a diameter substantially the same as the diameter of the shafts of the tools, and the generally square cutouts are provided in the top wall to have a depth and width substantially the same as the diameter of the handles of the tools. It is advantageous for the container means to comprise a generally rectangular box wherein the plurality of walls includes a generally rectangular bottom wall adapted to support the box on a supporting surface, and the top wall is also generally rectangular with the side wall having a front portion, a back portion, and two side portions completing the box. Still more specifically, the holes and cutouts which are provided in the top wall of the generally rectangular box are most advantageously arranged in alternating fashion with the cutouts each being defined by a flap formed by a through cut in the top wall along three sides thereof and a score line along a fourth side thereof.

In the preferred embodiment, the display panel comprises an integral extension of the back portion of the side wall and extends at least as high as the handles and the shafts of the tools displayed in the container. It is also advantageous for the display panel to have means associated therewith for hanging the container on a generally vertical supporting surface, thereby providing alternate means of support, i.e., the container can either be disposed on a generally horizontal supporting surface by simply setting it on the generally rectangular bottom wall or, alternatively, it can be hung on a generally vertical supporting surface. In a highly preferred embodiment, the holes and cutouts are arranged in alternating fashion in at least two rows to extend generally parallel to the integral extension of the back portion comprising the display panel.

As for other details, the flaps defining the square cutouts are preferably each movable from a position coplanar with the top wall to a position within the generally rectangular box to receive one of the tools. It is also advantageous for the display panel to include product indicia on at least a portion thereof whereby the consumer can gain information as to the nature/price of the product. Still further, the container preferably includes a shrink wrap type of material which is disposed about the box with the tools already disposed in position within the holes and cutouts in a point-of-sale manner.

As for the container, the display panel is preferably sized to extend to a point which is well above the handles and the shafts of the tools which are displayed in the container. It is also advantageous for the display panel to include a first fold line generally at the tipper extreme of the tools supported in the box, a second fold line above the first fold line a distance generally the same as the depth of the top wall, and an upper extreme which is above the second fold line a distance less than the distance from the top wall to the first fold line. With this arrangement, the display panel can be folded with a middle portion thereof parallel to the top wall and an upper and lower portion thereof coplanar with the front and back portions of the side wall, respectively.

As will be appreciated, this will serve to protect the tools that are already disposed in the holes and cutouts in point-of-sale fashion following which the shrink wrap can be applied to the box for shipping to the retailer.

In another respect, the present invention is directed to a foldable container which is formed of sheet material comprising a single blank including a rectangular box-forming portion and a display panel-forming portion. The rectangular box-forming portion is integral with the display panel-forming portion and includes, from the display panel-forming portion to an end remote therefrom, a back portion of a side wall of a rectangular box, a bottom wall of the rectangular box, a front portion of the side wall of the rectangular box, and a top wall of the rectangular box, and the rectangular box-forming portion includes a pair of side portions of the side wall of the rectangular box. More specifically, the side portions of the side wall are each integral with opposite ends of one of the front portion of the side wall, bottom wall, or back portion of the side wall.

With this arrangement, the foldable container is formed such that the top wall has a plurality of openings, including a plurality of round holes and also including a plurality of square cutouts. It is advantageous for the holes and cutouts in the top wall to be arranged in alternating fashion in at least two rows extending generally parallel to the front portion of the side wall. Preferably, the square cutouts in the top wall are each defined by a flap formed by a through cut in the top wall along three sides of the cutout and a score line along a fourth side thereof.

As for other details of the foldable container, the side portions are preferably integral with the front portion of the side wall and include upper and lower flaps extending therefrom of generally the same width as the top and bottom walls. The back portions of the side wall also each advantageously include a flap at each of opposite ends thereof. Still additionally, the top wall preferably includes a front flap extending therefrom of generally the same width as the top wall and of a depth no greater than the depth of the back portion of the side wall.

In a most highly preferred embodiment, the back portions of the side wall each include a flap extending therefrom of generally the same width as the side portions and of a depth no greater than the depth of the side portions of the side wall. It is also particularly advantageous for the foldable container to include a fold line between at least the back portion and the bottom wall, the bottom wall and the front portion, the front portion and the top wall, and the side portion and the one of the front portion, bottom wall and back portion with which the side portions of the side wall are integral. As previously noted, the side portions are preferably integral with the front portion of the side wall while also including upper and lower flaps extending therefrom.

Other objects, advantages and features of the present invention will become apparent from a consideration of the following specification taken in conjunction with the accompanying drawings.

DETAILED DESCRIPTION OF THE PREFERRED EMBODIMENT

Figure 1:
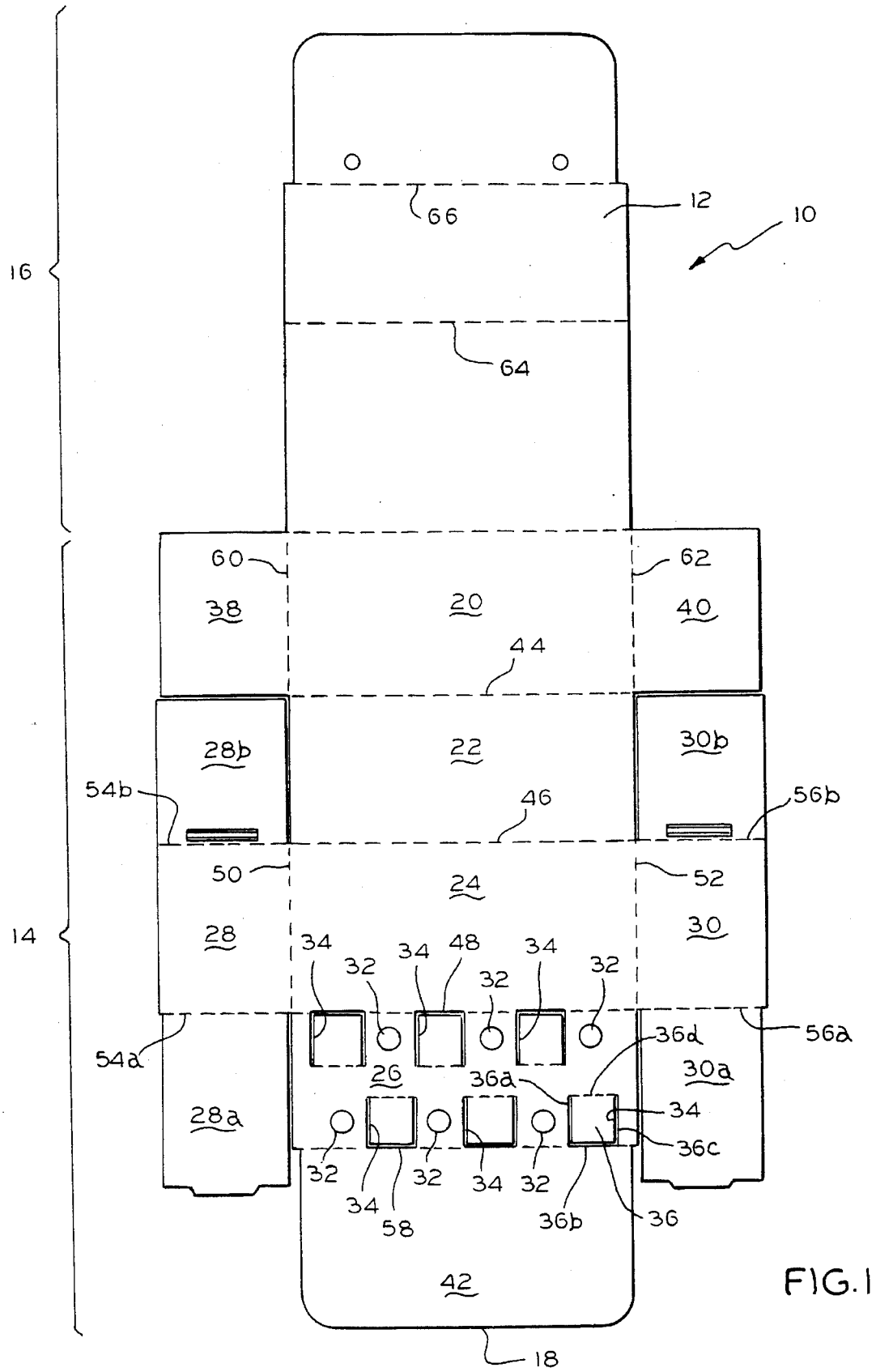
FIG. 1 is a top plan view of a foldable container which is formed of sheet material in accordance with the present invention.

In the illustrations given, and with reference first to FIG. 1, the reference numeral 10 designates generally a foldable container formed of sheet material 12, such as cardboard or like corrugated material in accordance with the present invention. The foldable container 10 comprises a single blank including a rectangular box-forming portion generally designated 14 and a display panel-forming portion generally designated 16. The rectangular box-forming portion 14 is integral with the display panel-forming portion 16 and includes, from the display panel-forming portion 16 to an end 18 remote therefrom, a back portion 20 of a side wall of a rectangular box (as will be described in detail hereinafter), a bottom wall 22 of the rectangular box, a front portion 24 of the side wall of the rectangular box, and a top wall 26 of the rectangular box. The foldable container 10 is such that the rectangular box-forming portion 14 also has a pair of side portions 28 and 30 of the side wall of the rectangular box. As will be seen from FIG. 1, the side portions 28 and 30 of the side wall each are integral with opposite ends of one of the back portion 20, bottom wall 22, and front portion 24, i.e., the front portion 24 in the illustrated embodiment.

Still referring to FIG. 1, the foldable container 10 is such that the top wall 26 has a plurality of openings including a plurality of round holes 32 and also including a plurality of square cutouts 34. The holes 32 and cutouts 34 in the top wall 26 will be seen to be arranged in alternating fashion in at least two rows extending generally parallel to the front portion 24 of the side wall. In this connection, the cutouts 34 in the top wall 26 are each defined by a flap 36 formed by a through cut in the top wall 26 along three sides **36*a*, 36*b*, and 36*c* of the cutout 34 and a score line 36*d*** along a fourth side thereof.

As shown in FIG. 1, the side portions 28 and 30 each include upper and lower flaps **28*a*, 28*b* and 30*a*, 30*b* extending therefrom of generally the same width as the top and bottom walls 26 and 22, respectively. The back portion 20 of the side wall also includes a flap such as 38 and 40 at each of opposite ends thereof. Further, the top wall 26 has a front flap 42 extending therefrom of generally the same width as the top wall 26 and of a depth no greater than the depth of the back portion 20** of the side wall.

As for the flaps 38 and 40 of the back portion 20 of the side wall, they are advantageously of generally the same width as the side portions 28 and 30 and of a depth no greater than the depth of the side portions 28 and 30 of the side wall.

As shown in FIG. 1, the foldable container 10 includes a fold line between at least the back portion 20 and the bottom wall 22 as at 44, the bottom wall 22 and the front portion 24 as at 46, the front portion 24 and the top wall 26 as at 48, and the side portions 28 and 30 and the front portion 24 as at 50 and 52. It will still additionally be seen that, in the preferred embodiment, the foldable container 10 will also include additional fold lines. More specifically, and as will be appreciated by referring to FIG. 1, the foldable container 10 will advantageously have a fold line between the side portions 28 and 30 and the respective flaps **28*a*, 28*b* and 30*a*, 30*b* substantially as illustrated at 54*a*, 54*b* and 56*a*, 56*b***, respectively.

As for other fold lines, there will preferably be a fold line as at 58 between the top wall 26 and the flap 42, fold lines as at 60 and 62 between the flaps 38 and 40 and the back portion 20 of the side wall, and fold lines as at 64 and 66 for a purpose to be described and understood in the description which follows in connection with FIGS. 2–6.

Referring now to FIGS. 2–6, the reference numeral 68 designates generally a container for displaying a plurality of tools 70, each of which has a handle 72 and a shaft 74. The container 68 comprises container means in the form of a generally rectangular box 76 defined by a plurality of walls, including at least a side wall 78 and a top wall 80. The top wall 80 has a plurality of openings, including a plurality of first openings 82 each formed to receive the shaft 74 of one of the tools 70 and to support the tool 70 with the handle 72 positioned thereabove and includes a plurality of second openings 84 each formed to receive the handle 72 of one of the tools 70 and to support the tool 70 with the shaft 74 positioned thereabove. The container 68 is also such that the container means in the form of the generally rectangular box 76 further includes a display panel 86 extending to a point above the top panel 80. With these features of construction, the first openings 82 are generally round holes in the top wall 80, and the second openings 84 are generally square cutouts in the top wall 80.

Figure 6:
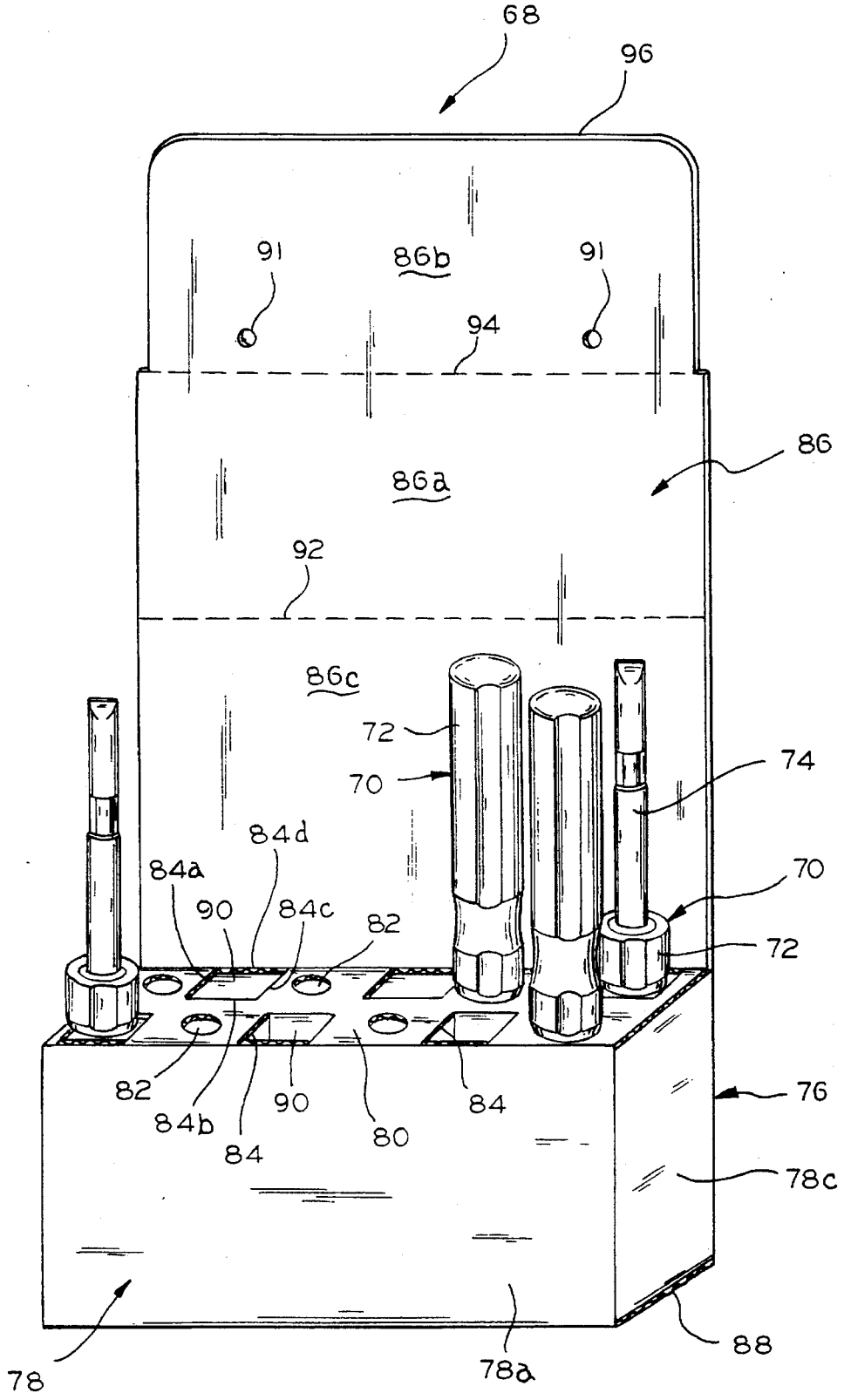
FIG. 6 is a perspective view after shipment of a container for displaying a plurality of tools in the point-of-sale position as more fully illustrated in FIG. 5.

Referring specifically to FIG. 6, the generally round holes 82 in the top wall 80 of the generally rectangular box 76 have a diameter substantially the same as the diameter of the shaft 74 of the tools 70. Similarly, and still referring to FIG. 6, the generally square cutouts 84 in the top wall 80 of the generally rectangular box 76 have a depth and width substantially the same as the diameter of the handle 72 of the tools 70.

Figure 2:
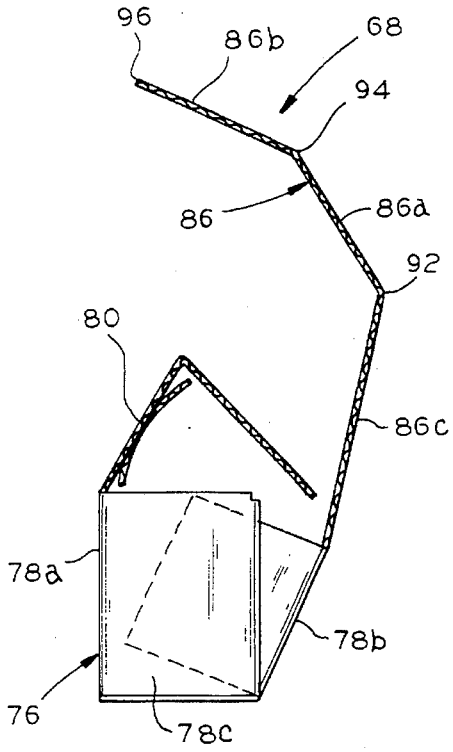
FIG. 2 is a side elevational view of the foldable container of FIG. 1 being formed into a container for displaying a plurality of tools.
Figure 4:
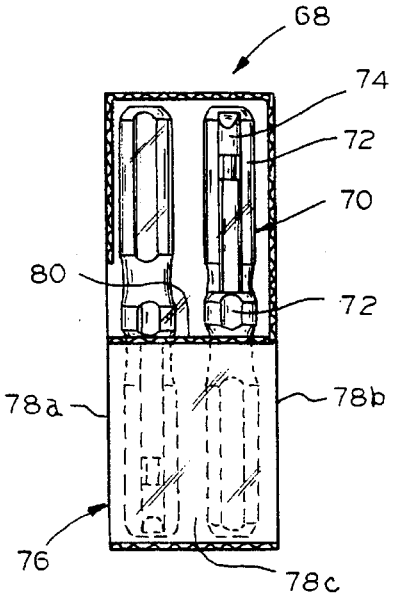
FIG. 4 is a side elevational view during shipment of the container for displaying a plurality of tools as more fully illustrated in FIG. 3.

In the illustrated embodiment, the generally rectangular box 76 includes not only a side wall 78 and a top wall 80 but also a generally rectangular bottom wall 88 (see FIGS. 2 and 4). The bottom wall 88 will be appreciated as being adapted to support the generally rectangular box 76 on a generally horizontal supporting surface and the top wall 80 will be seen to also be generally rectangular (see FIG. 6). As for the side wall 78, the generally rectangular box 76 is such that it includes a front portion **78*a*, a back portion 78*b*, and a pair of side portions 78*c* and 78*d* completing the box 76**.

Referring again specifically to FIG. 6, the holes 82 and cutouts 84 in the top wall 80 will be seen to be arranged in what may most accurately be called an alternating fashion. The square cutouts 84 are each defined by a flap 90 which is formed by a through cut in the top wall 80 through three sides **84*a*, 84*b*, and 84*c* thereof and a score line 84*b* along a fourth side thereof. As illustrated in FIG. 6, the holes 82 and cutouts 84 are most advantageously arranged in alternating fashion in at least two rows which extend generally parallel to the display panel 86**.

Figure 5:
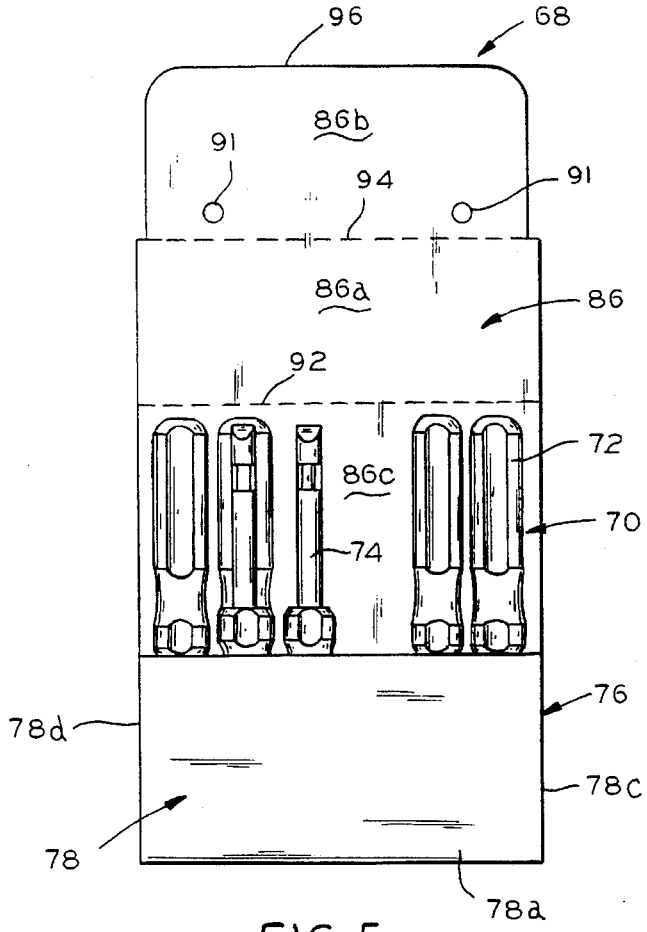
FIG. 5 is a front elevational view after shipment of a container for displaying a plurality of tools with a display panel folded into a point-of-sale position.

Referring to the display panel 86, it comprises an integral extension of the back portion **78*b* of the side wall 78 (see FIG. 2) and extends at least as high as the handles 72 and the shafts 74 of the tools 70 displayed in the container 68 (see FIG. 5). It will be noted that the display panel 86 has means, such as the holes 91, which are associated therewith for hanging the container 68 on a generally vertical supporting surface, such as a retail display rack or the like. As for the flaps 90 defining the square cutouts 84, they are each movable from a position coplanar with the remainder of the top wall 80 to a position within the generally rectangular box 76 to receive the handle 72 of one of the tools 70**.

As previously suggested and best shown in FIG. 6, the display panel 86 comprises an integral extension of the back portion **78*b* of the side wall 78 and extends to a point well above the handles 72 and the shafts 74 of the tools 70 displayed in the container 68. The display panel 86 may then advantageously include product indicia on at least the portions 86*a* and 86*b* thereof above the tool 70 for providing a consumer interested in the tools with information such as the nature and characteristics thereof as well as price and the like. In addition, the display panel 86 may preferably include a first fold line 92, a second fold line 94, and an upper extreme 96 whereby the display panel 86** may be folded for shipment from the manufacturer to the retailer.

As shown, the first fold line 92 is generally at the upper extreme of the tools 70 supported in the box 76, the second fold line 94 is above the first fold line 92 a distance generally the same as the depth of the top wall 80, and the upper extreme 96 is above the second fold line 94 a distance less than the distance from the top wall 80 to the first fold line 92.

With this arrangement, the display panel 86 may be folded with the middle portion **86*a* thereof parallel to the top wall 80 and the upper portion 86*b* and a lower portion 86*c* thereof coplanar with the front and back portions 78*a* and 78*b* of the side wall 78**, respectively.

Figure 3:
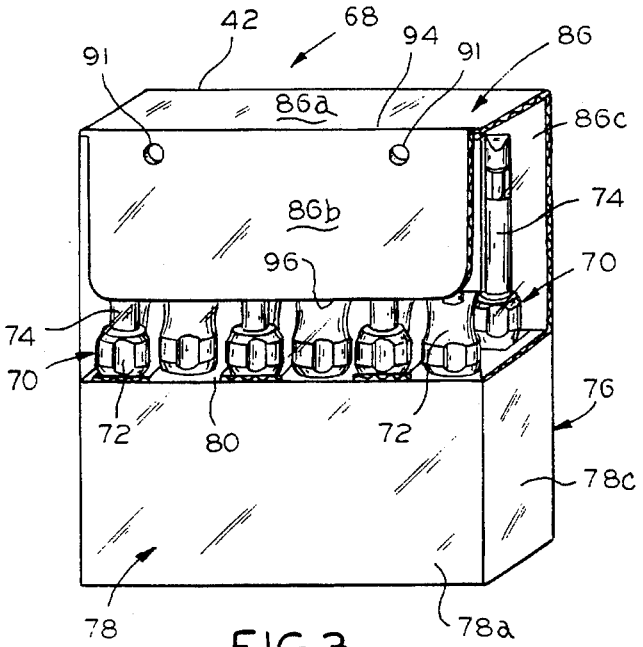
FIG. 3 is a perspective view during shipment of the foldable container of FIG. 1 formed into a container for displaying a plurality of tools.

As perhaps best illustrated in FIGS. 3 and 4, the container 68 may be shipped with the display panel 86 folded as described hereinabove. It is then advantageous to further include a shrink wrap as at 98 which may substantially entirely encase the container 68 in a manner where the tools 70 will be supported and retained in the holes 82 and the cutouts 84. With this arrangement, the container 68 offers a maximum of versatility in housing the tools 70 for shipment and, later, for retail display.

While in the foregoing there has been set forth a preferred embodiment of the invention, it will be appreciated that the details herein given may be varied by those skilled in the art without departing from the true spirit and scope of the appended claims.

I claim:

1. A container for displaying a plurality of tools each of which has a handle and a shaft, comprising:

container means defined by a plurality of walls including at least a side wall and a top wall, said top wall having a plurality of openings including a plurality of generally round openings each formed to be of a single, first uniform size to receive and support said shaft of one of said tools to thereby support said tool with said handle positioned thereabove and including a plurality of generally rectangular openings each formed to be of a single, second uniform size to receive and support said handle of one of said tools to thereby support said tool with said shaft positioned thereabove where said generally round and generally rectangular openings are arranged in alternating fashion, said container means further including a display panel extending to a point above said top wall.

2. The container of claim 1 wherein said generally round openings in said top wall have a diameter substantially the same as the diameter of said shaft of said tools and said generally rectangular openings are generally square cutouts in said top wall having a depth and width substantially the same as the diameter of said handle of said tools.

3. The container of claim 1 wherein said container means is a generally rectangular box, said plurality of walls including a generally rectangular bottom wall adapted to support said box on a supporting surface and said top wall is also generally rectangular, and said side wall includes a front portion, a back portion, and two side portions completing said box.

4. The container of claim 1 wherein said generally round openings are round holes in said top wall and said generally rectangular openings are square cutouts in said top wall, said holes and cutouts being arranged in alternating fashion, said square cutouts each being defined by a flap formed by a through cut in said top wall along three sides thereof and a score line along a fourth side thereof.

5. The container of claim 1 wherein said container means is a generally rectangular box and said side wall includes a front portion, a back portion, and two side portions defining said box, said display panel comprising an integral extension of said back portion of said side wall and extending at least as high as handles and shafts of tools to be displayed in said container.

6. The container of claim 1 wherein said container means is a generally rectangular box and said side wall includes a front portion, a back portion, and two side portions defining said box, said display panel comprising an integral extension of said back portion of said side wall having means associated therewith for hanging said container on a generally vertical supporting surface.

7. A container for displaying a plurality of tools each of which has a handle and a shaft, comprising:

a generally rectangular box defined by a plurality of walls including a side wall, a top wall, and a bottom wall, said top wall having a plurality of openings including a plurality of round holes each having a diameter substantially the same as the diameter of said shaft of said tools to receive and support said tools with said handles positioned thereabove and also including a plurality of square cutouts each having a depth and width substantially the same as the diameter of said handle of said tools to receive and support said tools with said shafts positioned thereabove, said generally rectangular box further including a display panel extending to a point above said top panel;

said holes and cutouts being arranged in alternating fashion in at least two rows extending generally parallel to said display panel.

8. The container of claim 7 wherein said plurality of walls includes said bottom wall being generally rectangular, said bottom wall being adapted to support said box on a generally horizontal supporting surface and said top wall also being generally rectangular, said side wall including a front portion, a back portion, and two side portions completing said box.

9. The container of claim 7 wherein said square cutouts each is defined by a flap formed by a through cut in said top wall along three sides thereof and a score line along a fourth side thereof, said flaps each being movable from a position coplanar with the remainder of said top wall to a position within said generally rectangular box to receive one of said tools.

10. The container of claim 7 wherein said display panel comprises an integral extension of said back portion of said side wall and extends to a point well above said handles and said shafts of said tools displayed in said container and has means associated therewith for hanging said container on a generally vertical supporting surface for displaying said tools therein.

11. The container of claim 10 wherein said display panel includes a first fold line generally at the upper extreme of said tools supported in said box, a second fold line above said first fold line a distance generally the same as the depth of said top wall, and an upper extreme above said second fold line a distance less than the distance from said top wall to said first fold line.

12. The container of claim 11 wherein said display panel includes product indicia on at least a portion thereof and still further including a shrink wrap disposed about said box when said display panel is folded with a middle portion thereof parallel to said top wall and an upper and lower portion thereof coplanar with said front and back portions of said side wall, respectively.

13. A foldable container formed of sheet material, comprising:

a single blank including a rectangular box-forming portion and a display panel-forming portion, said rectangular box-forming portion being integral with said display panel-forming portion and including from said display panel-forming portion to an end remote therefrom a back portion of a side wall of a rectangular box, a bottom wall of said rectangular box, and a top wall of said rectangular box, said rectangular box-forming portion also having a pair of side portions of said side wall of said rectangular box;

said side portions of said side wall each being integral with opposite ends of one of said front portion of said side wall, said bottom wall, or said back portion of said side wall;

said top wall having a plurality of openings including a plurality of round holes and also including a plurality of square cutouts.

14. The foldable container of claim 13 wherein said side portions are integral with said front portion of said side wall and include upper and lower flaps extending therefrom of generally the same width as said top and bottom walls.

15. The foldable container of claim 13 wherein said holes and cutouts in said top wall are arranged in alternating fashion in at least two rows extending generally parallel to said front portion of said side wall.

16. The foldable container of claim 13 wherein said top wall includes a front flap extending therefrom of generally the same width as said top wall and of a depth no greater than the depth of said back portion of said side wall.

17. The foldable container of claim 13 wherein said back portion of said side wall includes a flap extending therefrom at each of opposite ends of generally the same width as said side portions and of a depth no greater than the depth of said side portions of said side wall.

18. The foldable container of claim 13 wherein said square cutouts in said top wall are each defined by a flap formed by a through cut in said top wall along three sides of said cutout and a score line along a fourth side thereof.

19. The foldable container of claim 13 including a fold line between at least said back portion and said bottom wall, said bottom wall and said front portion, said front portion and said top wall, and said side portions and said one of said front portion, bottom wall, and back portion.

* * * * *

UNITED STATES PATENT AND TRADEMARK OFFICE

CERTIFICATE OF CORRECTION

PATENT NO. : 5,499,711

DATED : March 19, 1996

INVENTOR(S) : Burton Kozak

It is certified that error appears in the above-identified patent and that said Letters Patent is hereby corrected as shown below:

column 2, line 50, replace "tipper" with --upper--.

Signed and Sealed this

Twenty-third Day of July, 1996

*Attest:*

Bruce Lehman

BRUCE LEHMAN

*Attesting Officer*

*Commissioner of Patents and Trademarks*